US007171901B2

(12) United States Patent
Salvestro

(10) Patent No.: US 7,171,901 B2
(45) Date of Patent: Feb. 6, 2007

(54) FLEXOGRAPHIC PRINTING METHOD

(75) Inventor: Aldo Salvestro, Burnaby (CA)

(73) Assignee: Kodak Graphic Communications Canada Company, Burnaby (CA)

( * ) Notice: Subject to any disclaimer, the term of this patent is extended or adjusted under 35 U.S.C. 154(b) by 0 days.

(21) Appl. No.: 10/820,051

(22) Filed: Apr. 8, 2004

(65) Prior Publication Data

US 2004/0187721 A1 Sep. 30, 2004

Related U.S. Application Data

(63) Continuation-in-part of application No. 10/739,057, filed on Dec. 19, 2003, now Pat. No. 7,033,450, which is a continuation-in-part of application No. 10/271,991, filed on Oct. 17, 2002, now abandoned.

(30) Foreign Application Priority Data

Oct. 18, 2001 (CA) ..... 2359259

(51) Int. Cl.
*B41C 1/00* (2006.01)

(52) U.S. Cl. ..... 101/401.1; 101/463.1; 101/485; 430/22; 430/300; 430/306

(58) Field of Classification Search ..... 101/401.1, 101/463.1, 485, 486; 430/22, 273.1, 300, 430/306

See application file for complete search history.

(56) References Cited

U.S. PATENT DOCUMENTS 2,111,914 A * 3/1938 Kohlberger ..... 101/401.1
3,103,880 A * 9/1963 Sanford et al. ..... 101/136
4,643,094 A * 2/1987 Holmstrom ..... 101/401.1
5,205,039 A * 4/1993 Ternes ..... 29/895.21
5,752,445 A * 5/1998 Ruggiero et al. ..... 101/486
5,846,691 A * 12/1998 Cusdin et al. ..... 430/300
6,161,479 A * 12/2000 Murray ..... 101/453
6,312,871 B1 11/2001 Cusdin et al.
6,312,872 B1 11/2001 Murphy et al.
6,399,281 B1 6/2002 Cusdin et al.
6,472,121 B2 10/2002 Murphy et al.
6,823,793 B2 * 11/2004 Dewitte ..... 101/485
2002/0025492 A1 2/2002 Murphy et al.
2003/0037687 A1 2/2003 Aubanel
2003/0053138 A1 3/2003 Klein et al.

* cited by examiner

*Primary Examiner*—Daniel J. Colilla
*Assistant Examiner*—Jill E. Culler
(74) *Attorney, Agent, or Firm*—Donna P. Suchy

(57) ABSTRACT

Methods and apparatus are provided for improving the accuracy and streamlining the process of preparing an imaged flexographic printing sleeve. Seam layout details are determined by a controller and transferred to an automated cutting device to cut flexographic precursor sections. The controller can also control a printing device to print indicia on a sleeve substrate for use in aligning the cut precursor sections. The controller can also control a mounting device for the mounting of the cut precursor sections. An imaging engine for imaging a flexographic printing sleeve is equipped with an edge detection system for determining the location of seams between abutting precursor sections.

26 Claims, 9 Drawing Sheets

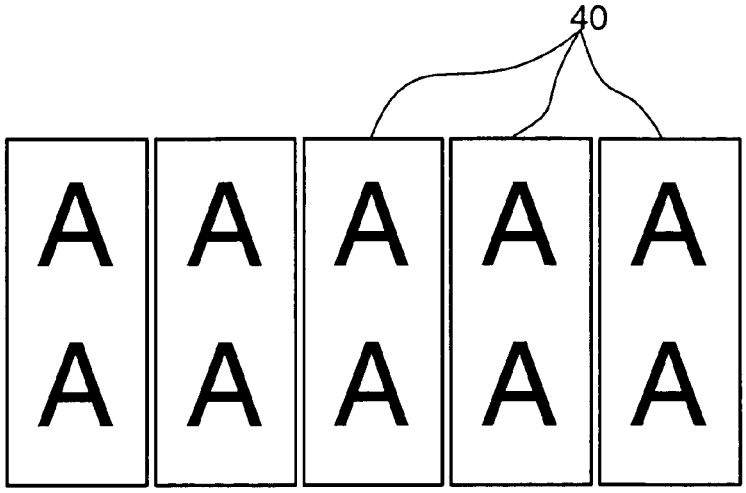
FIG. 1-A
Prior Art
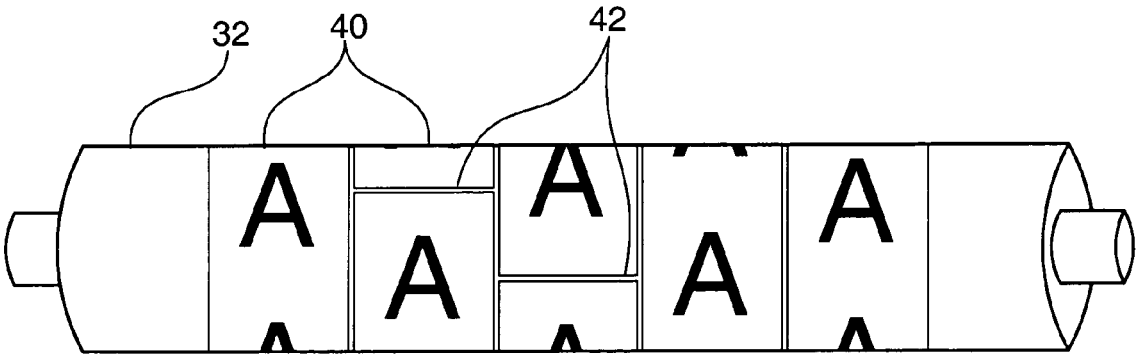
FIG. 1-B
Prior Art

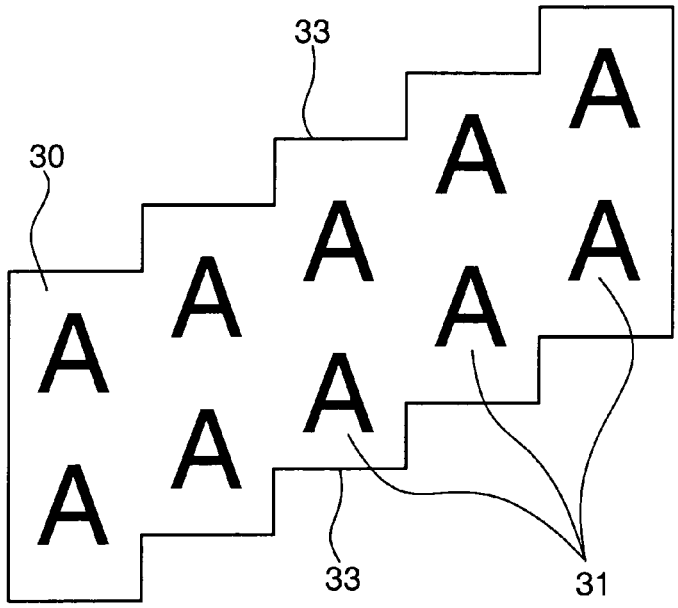
FIG. 1-C
Prior Art
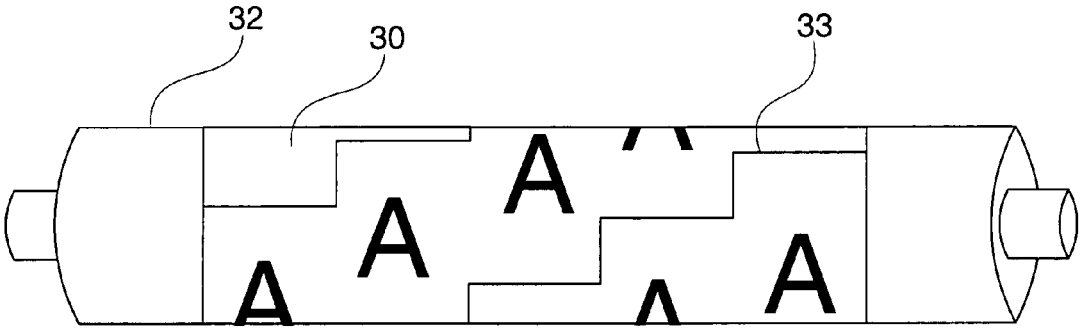
FIG. 1-D
Prior Art

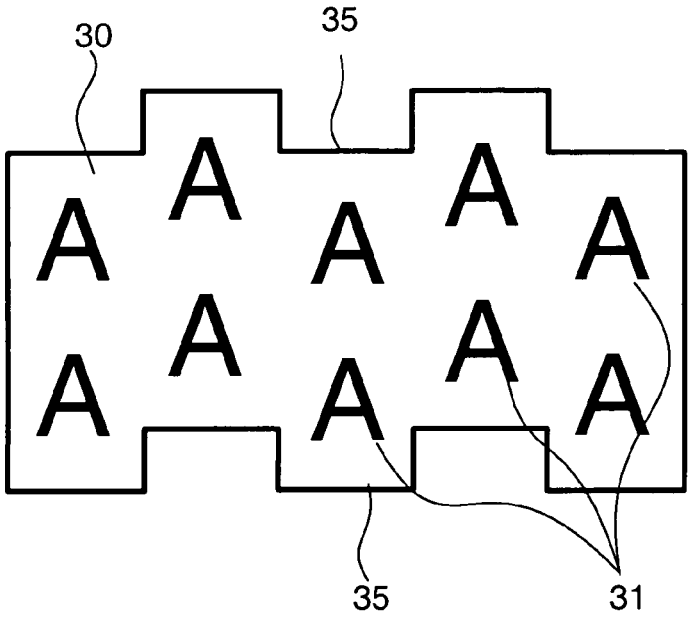
FIG. 1-E
Prior Art
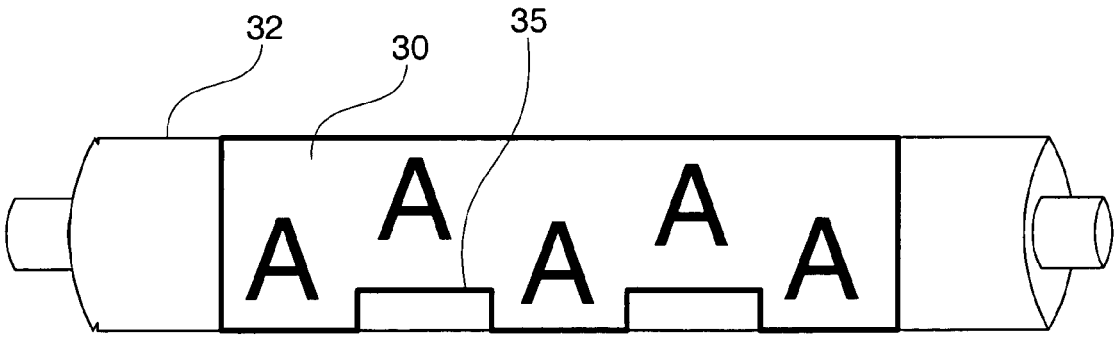
FIG. 1-F
Prior Art

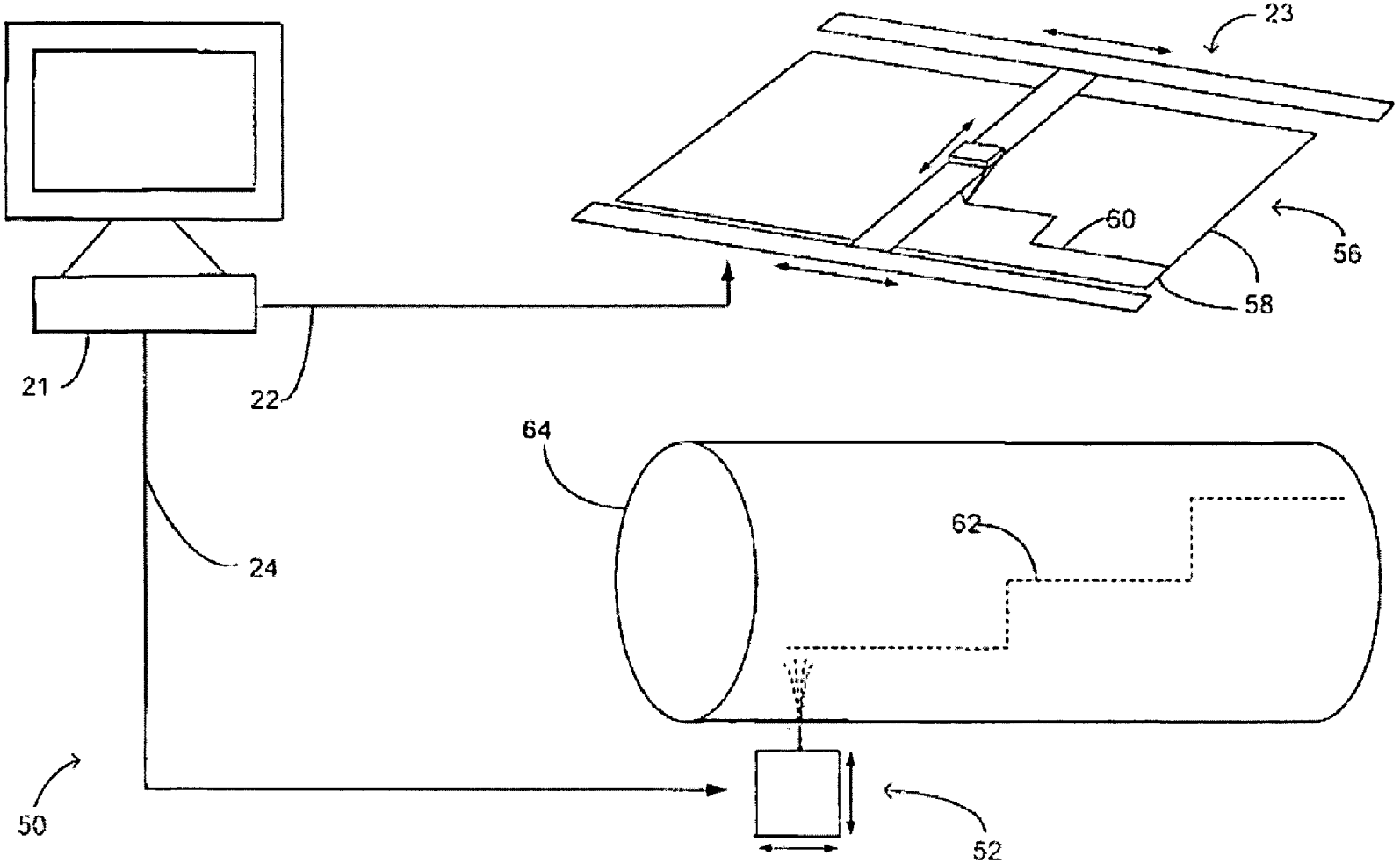
FIG. 4-A

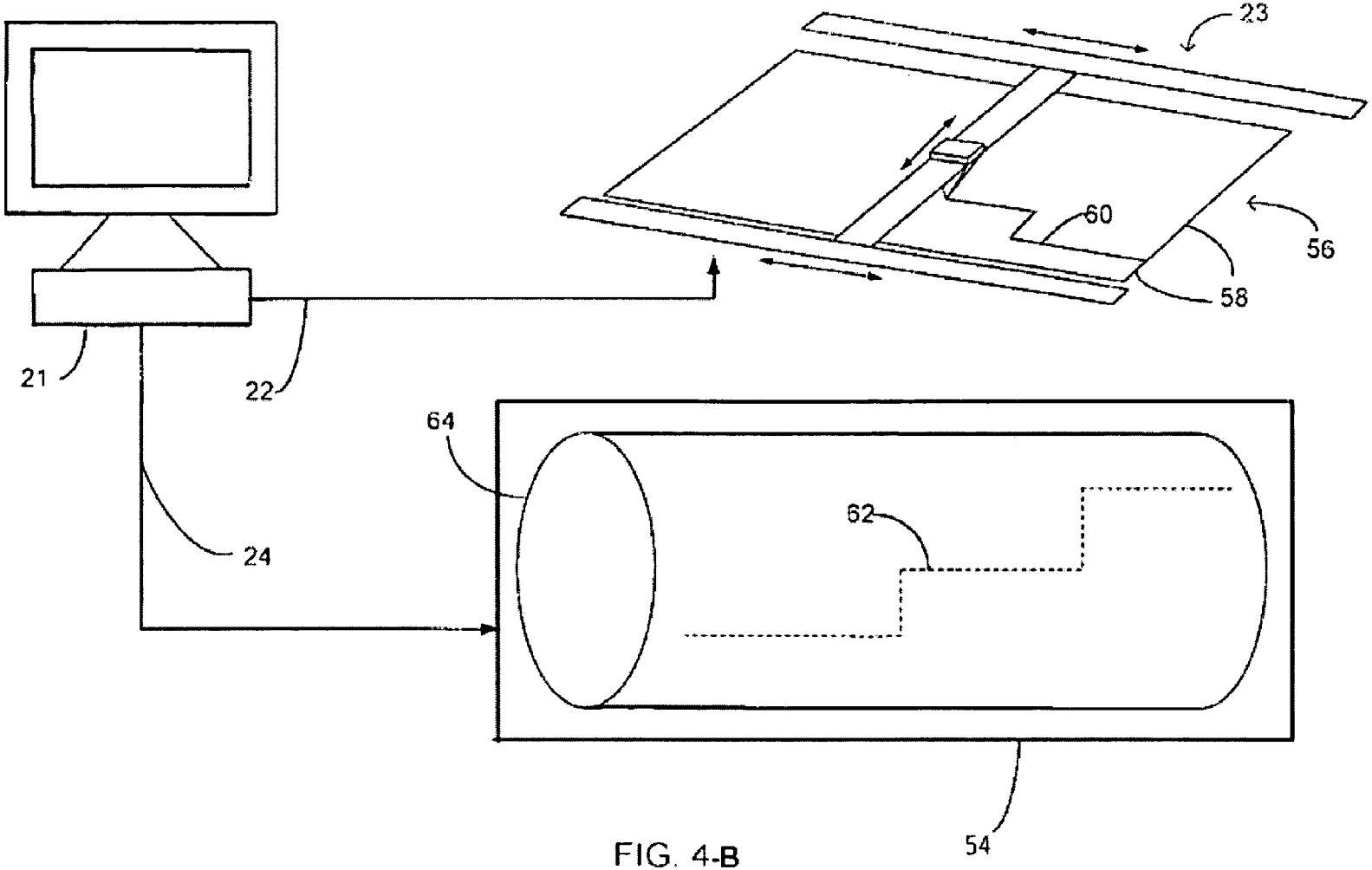
FIG. 4-B

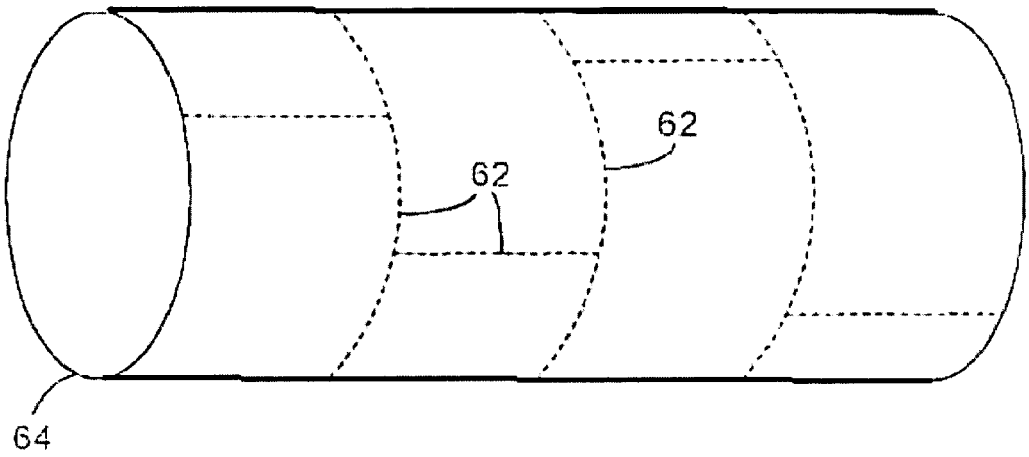
FIG. 5-A
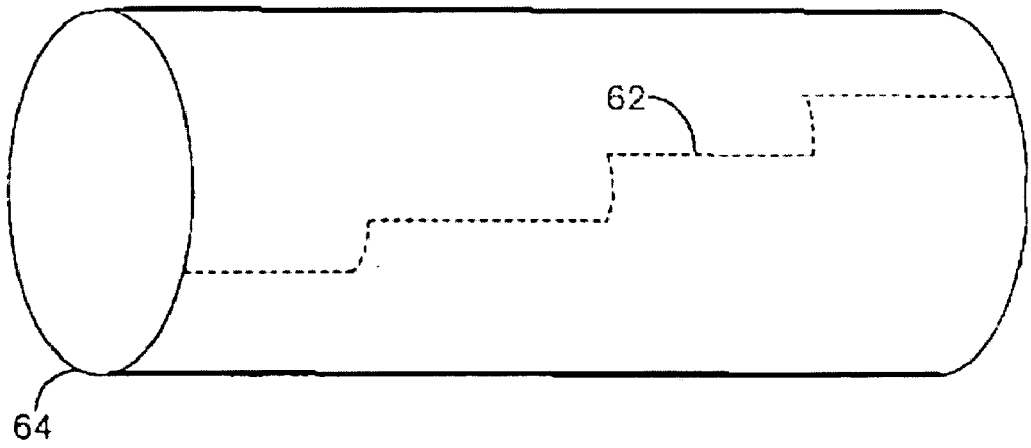
FIG. 5-B

FLEXOGRAPHIC PRINTING METHOD

RELATED APPLICATIONS

This is a continuation-in-part of U.S. application Ser. No. 10/739,057 filed on Dec. 19, 2003 now U.S. Pat No. 7,033,450 entitled "Flexographic printing method" which is a continuation-in-part of U.S. application Ser. No. 10/271,991 filed on Oct. 17, 2002 now abandoned entitled "Flexographic printing method".

The benefit of the filing date of Canadian patent application No. 2,359,259 filed 18 Oct. 2001 is claimed herein.

TECHNICAL FIELD

This invention relates to flexographic printing, and more specifically to an improved process for preparing flexographic printing sleeves.

BACKGROUND

Flexographic printing is a method of direct rotary printing that uses resilient relief image plates. The plates are typically made of rubber or photopolymer. Flexographic printing has found particular application in packaging where it has displaced rotogravure and offset lithography printing techniques in many cases. While flexographic printing can produce high quality printed products, making flexographic printing formes according to prior art processes can be undesirably time consuming and labor intensive.

Typical conventional flexographic plates have a flat polyester support layer coated with a photopolymer layer. The photopolymer layer is sensitive to ultraviolet (UV) radiation, such that it cross-links or hardens when exposed to UV light. In a first step, exposing the back of the plate to UV light sets a "floor". The floor forms the base of the relief that will be formed in further imaging steps. A protective cover-sheet is then typically removed from the top of the plate. A film mask comprising image-wise information, is placed over the top of the photopolymer layer, and is drawn down by a vacuum frame to ensure good contact. The photopolymer layer is then flood exposed to UV light through the film mask, thereby image-wise hardening or cross-linking the regions of the photopolymer layer that are exposed by the mask. The film mask is then removed and the plate is typically processed in solvents to remove the non-UV exposed areas of the photopolymer layer, thus producing an image-wise relief of the cross-linked areas. After processing with solvents the plate is dried. Drying can take several hours. The plate may then undergo additional UV treatments to further cross-link the plate, or to improve the quality aspects such as tackiness.

Digital flexography follows a similar process except that digital flexographic plates have an integral UV-opaque mask layer coated over the photopolymer layer. A computer-to-plate (CTP) digital imager with a high-power laser imaging head is then employed to digitally image or image-wise ablate the mask layer (after any protective cover sheet has been removed) to form an image mask that is substantially opaque to UV light in the non-ablated areas. Once the mask is formed, processing of the plate continues as it would for conventional flexographic plates except that there is no need to use a vacuum frame to ensure good contact between the mask and photopolymer layer since the mask layer is integral with the photopolymer layer. Other flexographic plate formulations, such as Cyrel® Fast made by E. I. Dupont de Nemours and Company, eliminate the use of solvents for the processing step and reduce the combined processing and drying time.

The imaged and processed flexographic plates are then mounted on a flexographic press cylinders using an adhesive layer such as a double sided adhesive tape or foam. The adhesive layer is commonly referred to as "sticky-back". Each cylinder represents a specific color to be printed. Consequently, the flexographic plates corresponding to a specific color must be mounted accurately onto a cylinder such that they will be in precise registration with the other flexographic plates mounted onto the cylinders corresponding to the other colors to be printed. The plates are typically mounted with a post-mounting device. This registration and mounting is typically accomplished with post-mounters that employ mechanical and/or electronic means such as video cameras and monitors, or optical means such as mirrors which reflect an image of a corresponding pattern mounted on an auxiliary drum. Examples of post mounting devices include the Cyrel® Macroflex mounter from E. I. Dupont de Nemours and Company, and the Mount-O-Matic® plate mounting systems from Anderson and Vreeland Inc. Accurate registration is key in producing a high quality printed product. This is further complicated by the fact that the top image surface of the flexographic plate stretches disproportionably from its base surface when the plate is stretched around the cylinder. This distortion must be compensated for during the production of the plate. Hence, conventional flexographic plate mounting can be finicky, and time consuming, and is thus typically preformed by skilled operators.

When a rectangular flexographic plate is mounted on a press cylinder there is a gap or "seam" where the top and bottom of the plate approach one another. On the printing press, the media to be printed, herein referred to as the "printing stock", is backed by an impression cylinder. The flexographic relief plate mounted on a press cylinder is brought into contact with the printing stock. The flexographic printing plate mounted on the press cylinder is thus intimately pressed against the printing stock until the required contact pressure for the printing operation is achieved. A continuous plate seam across the press cylinder would contact the impression cylinder on each rotation, and the resulting discontinuity in uniform impression squeeze would very likely lead to irregularities in the final printing. This phenomenon is known as "plate bounce" or "cylinder bounce". Plate bounce puts an upper limit on the printing speed, beyond which printing errors may occur.

A common method of reducing the effects of plate bounce is to stagger the seam around the cylinder. This method is particularly effective when a stepped and repeated pattern is required across the press cylinder. The plates are arranged to provide a continuous bearing surface throughout the full rotation of the press cylinder. A staggered seam can be achieved by laying out the image so that several plate sections are applied to the cylinder in what are known as "lanes". In FIG. 1-A a number of plate sections 40 have been cut and imaged and in FIG. 1-B plate sections 40 are shown wrapped around a cylinder 32. Each seam 42 is offset from the seams of other lanes so that they are distributed around the circumference of the cylinder. Consequently the impression cylinder no longer falls into a seam since it is always riding on the image relief of one or more lanes.

A staggered seam may also be achieved by cutting the plate seam in a staircase shape. FIG. 1-C shows a photopolymer plate 30 cut with a staircase seam 33. The seam layout has the same repeat as the image elements 31. In FIG. 1-D plate 30 is shown wrapped around cylinder 32. The location of seam 33 is chosen so that the plate completely wraps around the cylinder with the seams precisely lining up.

Alternatively, a staggered seam may also be achieved by cutting the plate seam in a "castle-top" shape. FIG. 1-E shows a photopolymer plate 30 cut with a castle-top seam 35. The seam layout has the same repeat as the image elements 31. In FIG. 1-F plate 30 is shown wrapped around cylinder 32. The location of seam 35 is chosen so that the plate completely wraps around the cylinder with the seams precisely lining up.

While a staggered seam is effective in reducing the effects of plate bounce, the manual cutting, mounting, and registration of the processed plates on a press cylinder is more complicated, more time consuming and may not provide the accuracy required for high quality printing.

To avoid registration problems, digital flexographic plates may be imaged, UV exposed and processed after being mounted onto a press cylinder. In this way, the registration accuracy is provided by the imaging device, which can place an image very accurately. The digital plates sections need only be mounted in approximate registration and compensation for plate mounting distortion is virtually eliminated. The UV exposure and processing of a plate imaged while on a cylinder in this manner requires specialized "in-the-round" (ITR) equipment, now commonly available, that can operate on cylindrical plate formes, rather than flat plates.

Make-ready time is the overhead time associated with mounting and registering plates on press to prepare for the print job. In order to reduce make-ready times, flexographic plates are mounted on sleeve substrates, rather than directly on press cylinders. A sleeve substrate typically comprises a cylindrical tube of nickel, polyester or some other material. The sleeve substrate material is chosen to have a certain degree of elasticity so that air pressure can be used to expand the sleeve substrate slightly, thus allowing it to be slid over a press cylinder on a cushion of air. Once the air supply is removed, the sleeve substrate shrinks so that it is held tightly in place. Thus, sleeve substrates allow for the quick job changeovers on press, since the flexographic plate sections no longer need to be mounted directly on press cylinders. Further, the mounted plates can be stored while still on the sleeve substrates and thereby reused in the future when their respective print job needs to be run again.

Sleeve substrates can be employed to further enhance the quality and productivity improvements associated with imaging, UV exposing and processing digital plates "in-the-round". In this manner, one or more un-imaged digital flexographic plate sections are mounted on a sleeve substrate using double-sided tape. The cut sections are wrapped around the sleeve substrate in approximate registration and are then imaged on a digital CTP imager. Finally, the sleeve substrate is UV exposed and processed "in-the-round" to produce a flexographic printing forme that is then ready to be engaged onto a printing cylinder for use in a flexographic printing operation. This process is known in the industry as digital Plate-on-Sleeve (PoS).

FIG. 2 shows a flow diagram of a prior art process for making a typical digital PoS flexographic printing forme. A flexographic printing precursor 1 comprising a photopolymer layer and a UV opaque mask layer is back exposed in step 2 to set a floor for the relief image. In step 3 the flexographic printing precursor is typically manually cut into precursor sections so that they can be applied to a sleeve substrate in lanes to form a staggered seam. The precursor sections are then mounted on a sleeve substrate using double-sided tape in step 4 to produce a flexographic printing sleeve. Alternatively, the flexographic printing precursor may be cut to form a precursor section with a staggered seam as shown in FIG. 1-C or FIG. 1-E and mounted as a single piece to a sleeve substrate in step 4. The degree of required accuracy is typically less than that required from conventionally mounting imaged and processed media on a sleeve substrate. However, the cutting and registration of the precursor sections need to be sufficiently accurate enough to ensure that the subsequent imaging will not run into a seam. This requires that the imaging be registered or indexed to the seams created by the mounted precursor sections. Known indexing methods are crude and time consuming and involve manually trying to align the imaging beam to a seam, or imaging a sacrificial "rule" on at least one of the mounted precursor sections and then offsetting the start of imaging as per the measured distance between the seam and the rule zero point.

Referring again to FIG. 2 image data 7 is typically pre-formatted by one or more computer workstations connected to a network to enable file or data transfer. A packaging workflow system 5 and a controller 6 combine to layout an image including the details of how it will be imaged and printed. These workstations provide functionality enabling an operator to take an image file from a customer and arrange the image for optimal printing.

The UV opaque mask layer is then ablated in a digital imager 8 according to the image data 7. It is critical that the imaging be referenced to the seams between the mounted precursor sections. Failure to do so may result in the imaging running into the seam to produce undesirable results. The flexographic printing sleeve is then exposed to UV light in step 9, hardening or cross-linking areas where the UV opaque mask layer has been ablated. A processing step 10 follows. Processing may include washing in solvents, drying, and a final UV exposure to fully harden the photopolymer and remove tackiness. The finished photopolymer printing forme 11 is then ready for printing on a flexographic press.

Direct engraving of flexographic plates is also known in the art. Typically a high power laser is used to remove the unwanted material thus forming a relief image. In U.S. Pat. No. 5,416,298 to Robert, an apparatus for preparing a printing medium for use in a printing process uses a laser beam to directly engrave the medium. The printing medium may include a printing cylinder for a flexographic printing process. The patent describes an acousto-optic modulator for deflecting the beam over the surface of the medium being engraved. Direct engraving combines the imaging and processing steps. The process of FIG. 2 can be adapted to the direct engraving of flexographic media mounted on sleeve substrates, by noting that the removal of unwanted media is accomplished by the imaging means and not the processing means in this application.

Digital computer-to-plate devices for imaging such flexographic printing sleeves are typically built in the general form of a lathe. Such machines have a mandrel on which a flexographic printing sleeve can be mounted, a fixed headstock for driving the flexographic printing sleeve, a moveable tailstock for supporting the flexographic printing sleeve, and a traveling imaging head. The imaging head typically has a radiation source, such as a laser, capable of image-wise ablating the mask layer or the photopolymer itself.

There are advantages to using a digital PoS process to make a flexographic printing forme. However, existing PoS processes are still time-consuming and tedious. Manual steps introduce poor repeatability into the process and extend the make-ready time. There is a need for methods for streamlining the making of flexographic printing formes. In high quality printing there is a particular need for methods for cutting, handling, mounting, and imaging sections of flexographic printing precursor on a sleeve substrate in such a manner that registration errors are minimized. There is also a further need to reduce the time taken to produce a flexographic printing forme with plate-on-sleeve techniques.

SUMMARY OF THE INVENTION

In a first aspect of the present invention, a method and system are provided for automating the cutting of a flexographic printing precursor into one or more precursor sections for application to a sleeve substrate. A controller is operative to provide seam layout information comprising cutting data and identification information for the automated cutting operation.

In another aspect of the invention, the controller is also operative to provide registration information to a printing device capable of printing registration marks on a sleeve substrate to facilitate the mounting of the sections of the flexographic printing precursor.

In another aspect of the invention, the controller is also operative to provide registration information to a mounting device that is capable of mounting precursor sections on sleeve substrate.

In another aspect of the invention, a method and apparatus for preparing a flexographic printing composite involves attaching one or more precursor elements to an imaging drum such that there is at least one seam. The location of the seam is then detected and an image is formed on the one or more sections, the image being located in aligned relation to the detected location of the seam.

A significant advantage of the Plate-on-Sleeve process outlined herein is that the accuracy of the operation is improved while the time taken by tedious manual operations is reduced. The application of methods of the present invention will improve the productivity of these processes and improve color-to-color registry. The possibility of operator error is also reduced.

BRIEF DESCRIPTION OF THE DRAWINGS

In drawings which illustrate by way of example only preferred embodiments of the invention:

FIG. 1-A is a depiction of a prior art flat flexographic printing precursor cut into lanes;

FIG. 1-B is a depiction of a prior art flexographic printing precursor mounted on a printing cylinder in lanes with staggered seams;

FIG. 1-C is a depiction of a prior art flat flexographic printing precursor cut with a staircase seam;

FIG. 1-D is a depiction of a prior art flexographic printing precursor with a staircase seam wrapped around a printing cylinder;

FIG. 1-E is a depiction of a prior art flat flexographic printing precursor cut with a castle-top seam;

FIG. 1-F is a depiction of a prior art flexographic printing precursor with a castle-top seam wrapped around a printing cylinder;

FIG. 4-A schematically shows an embodiment of a system according to the invention;

FIG. 4-B schematically shows another embodiment of a system according to the invention;

FIG. 5-A shows a sleeve substrate with registration marks corresponding to a staggered seam printed thereon;

FIG. 5-B shows a sleeve substrate with registration marks corresponding to a staircase seam printed thereon;

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than restrictive sense.

Figure 2:
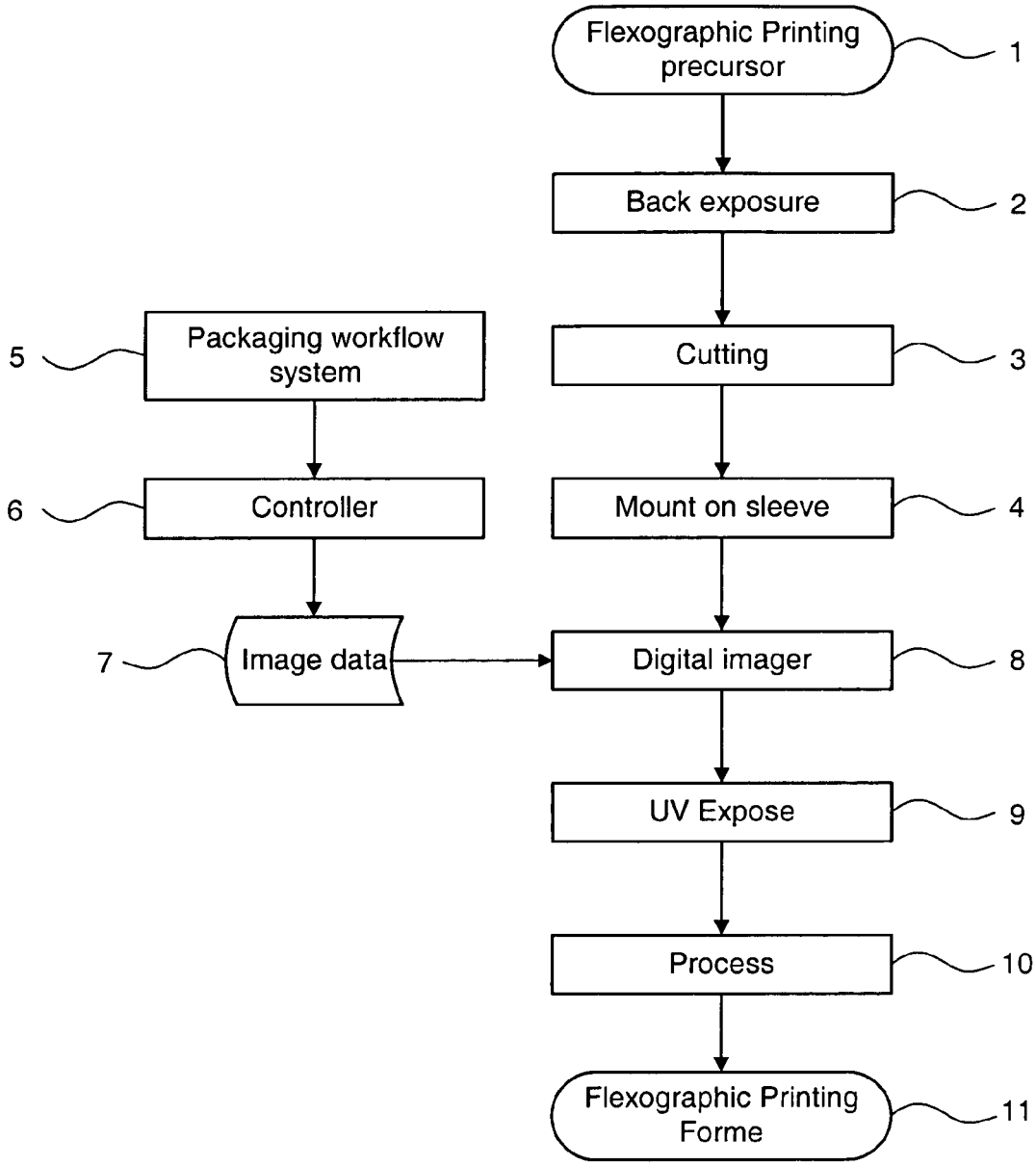
FIG. 2 Prior Art
FIG. 2 is a flowchart illustrating a prior art process for making a flexographic printing forme.
Figure 3:
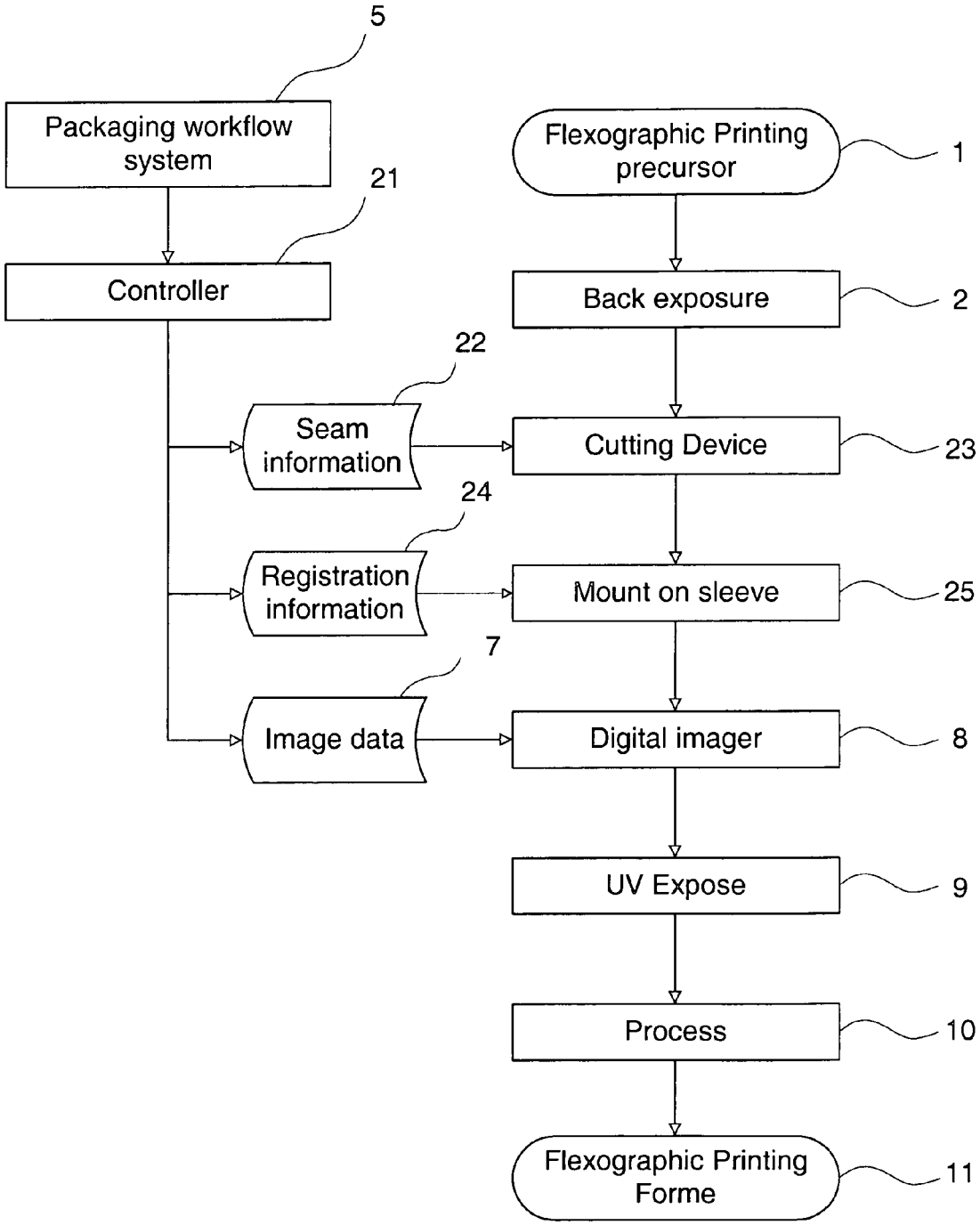
FIG. 3 is a flowchart illustrating an improved method according to this invention.

FIG. 3 is a flowchart illustrating an embodiment of the present invention. The invention provides automatic methods and apparatus for producing and imaging flexographic printing sleeves.

In the present specification, the term "flexographic printing precursor" is used to describe an un-imaged layer of material that is to be subsequently image-wise converted and processed to form a relief surface for printing. A flexographic printing precursor can be image-wise converted and processed by digitally imaging a mask of the material. In this case, the mask is used in any subsequent processing steps. Digitally imaging a mask can comprise the image-wise ablation of the mask. Alternatively, the imaging and processing steps can be substantially combined when the digital imaging is used to directly ablate or engrave the layer of material itself. The term "precursor section" is used to describe an un-imaged section that has been separated from a flexographic printing precursor. The term "sleeve substrate" is used to describe a cylindrical tube of material that is to be used as a base to support a precursor section. The term "flexographic printing sleeve" is used to describe a sleeve substrate on which at least one piece of precursor section has been mounted. The term "flexographic printing forme" is used to describe a flexographic printing sleeve that has been image-wise converted, exposed and processed and is capable of being mounted onto a press cylinder for use in a flexographic printing operation.

FIG. 3 shows a controller 21, which can comprise a software program running on a computer workstation. Controller 21 facilitates the interactive arrangement of sections of flexographic printing precursor on a sleeve substrate to produce a desired seam layout for the resulting flexographic printing sleeve. Controller 21 comprises a display such as a computer workstation monitor. An operator is able to view on the display a facsimile of the printing image required to be imaged on the flexographic printing sleeve. Software running in controller 21 allows an operator to define a desired seam layout. The operator can use an input device, such as a mouse, light pen, trackball, touch-sensitive screen or the like to draw in or manipulate seams to create an arrangement of one or more sections of flexographic printing precursor. Controller 21 can additionally be programmed with functionality to aid the operator by suggesting a seam layout calculated according to an algorithm. This algorithm may be set to suggest possible seam layouts based upon various inputs provided by the operator. Additionally, the algorithm may be set to minimize plate wastage or some other optimization function. The seam layout can comprise, for example, a number of lanes, a staircase seam, a castle-top seam, or any other complex patterned seam. The seam layout information will represent a defined arrangement of appropriately sized and shaped precursor sections that can be imaged accordingly with respect to the image content bounded by the seam layout. The precursor sections can be cut into substantially rectangular shaped pieces that are mounted in a "lanes" configuration. Alternatively, a precursor section can be cut with a staircase shape, a castle-top shape or any other complex shape.

Once the arrangement has been defined, controller 21 transfers seam layout information 22 to a controllable cutting device 23. Controllable cutting device 23 cuts the flexographic printing precursor into one or more precursor sections according to the seam location information provided to it by controller 21. The cuts could divide the flexographic printing precursor into simple rectangular sections, or sections with a staggered seam, or even sections with a more complex seam layout. Further, controller 21 can adjust the size of the precursor sections to be cut under the influence of seam layout information 22. This size adjustment can correct for differential elongation effects that are created between the base and topside of a precursor section as it is wrapped around a sleeve substrate.

Controller 21 can implement a packaging workflow system 5 that controls the process of converting image copy into flexographic printing formes. An example of such a packaging workflow system is Prinergy Powerpack™ sold by Creo Inc of Burnaby, British Columbia, Canada. Prinergy Powerpack is a fully integrated and automated workflow management system designed specifically to meet the needs of offset and flexographic converters. Controller 21 can comprise any combination of one or more data processors and can be a stand-alone device or connected together with other devices in a computer network. Information or data transfer can be accomplished in a variety of manners and this application should be understood to cover any means of file or data transfer via any form of data storage or transmission. The term "information" used in reference to seam layout includes any form of data or encoding that can be used to transfer seam layout details to define and cut precursor sections from a flexographic printing precursor.

FIG. 4-A schematically depicts system 50 comprising a controller 21, a cutting device 23, and a printing device 52. Controller 21 can comprise an interactive user interface that allows an operator (not shown) to designate an arrangement of precursor sections on a sleeve substrate. Controller 21 provides seam layout information 22 to cutting device 23 and registration information 24 to printing device 52 based on the arrangement designated by the operator. The term "information" used in reference to registration includes any form of data or encoding that can be used to transfer registration details to either control the printing of registration marks on a sleeve substrate, or to control the registration of precursor sections that are mounted on a sleeve substrate with the aid of a mounting device.

Cutting device 23 is configured to cut a flexographic printing precursor 56 into precursor sections 58 according to seam layout information 22. A suitable controllable cutting device 23 is produced by Misomex International of Nashua, N.H. Misomex have a range of flatbed x-y plotting machines with cutting heads available. Such machines are capable of quickly and accurately cutting many types of material. Flexographic printing precursor 56 can have a removable protective cover-sheet on its outer, imagable surface. Flexographic printing precursor 56 can additionally have a support layer on its inner surface; the inner surface being the surface that would be closest to a sleeve substrate when a section of flexographic printing precursor is mounted on the sleeve substrate. Flexographic printing precursor 56 can be cut with a protective layer intact or removed. Further, cutting device 23 can either first begin cutting into the protective cover-sheet or into the support layer of flexographic printing precursor 56, depending on the operator's preference and controller 21 settings. Any cutting device capable of cutting a flexographic printing precursor in accordance with seam layout information 22 provided by controller 21 could be used in this invention, and can include, but is not limited to, laser cutting and water-jet cutting devices. In the FIG. 4-A embodiment, cutting device 23 is shown cutting a staircase seam 60. Cutting device 23 does not have to be a flatbed device; the plate could also be cut on a cylinder. Additionally, some cutting devices are available with a pen plotter head or other marking means (not shown) that can be used to place reference indicia or reference characters (not shown) on precursor sections 58. The reference indicia or reference characters are preferably placed on the cover-sheet or support layer of precursor sections 58. The reference indicia or reference characters can be operator definable and are provided by seam layout information 22. Reference indicia can be used in a later step to align precursor sections to the substrate during mounting. Reference characters can be used to uniquely identify precursor sections to avoid operator mistakes and confusion when mounting the precursor sections 58 to their respective sleeve substrates. Further, the reference indicia can be used to visually outline the precursor sections on flexographic printing precursor 56, prior to cutting to help ensure that there is sufficient material to cut precursor sections 58 from.

In another embodiment of the present invention, FIG. 4-A shows printing device 52 that is configured to print registration marks 62 on sleeve substrate 64, according to registration information 24 provided by controller 21. Registration marks 62 can compromise outlines, corner placement marks, crosshair targets, or any other format and can correspond to the edges of precursor sections 58. Printing device 52, in accordance to registration information 24 can also print instructions or reference characters (not shown) on sleeve substrate 64 to facilitate the later mounting of precursor sections 58. Printing device 52 can comprise an inkjet printer head in a stand-alone device, or can also include an inkjet printer head integrated into a mounting device, or even, a digital imaging device. Printing means, other than inkjet are also not precluded from being used in this specification.

In the FIG. 4-A embodiment, cutting device 23 is shown cutting a staircase seam 60, and printing device 52 is shown printing staircase-shaped registration marks 62. FIG. 5-A depicts a sleeve substrate 64 with registration marks 62 printed thereon that correspond to an arrangement of precursor sections (not shown) in lanes to produce a staggered seam. FIG. 5-B depicts a sleeve substrate 64 with registration marks 62 printed thereon that correspond to an arrangement of a single staircase-shaped precursor section (not shown) to produce a staircase seam. It is to be understood that other seam configurations are equally within the spirit and scope of the invention.

An adhesive layer can be applied to sleeve substrate 64 before registration marks 62 are printed thereon. Once the adhesive layer, which can comprise double-side tape, is applied to the sleeve substrate 64, registration marks 62 are printed onto the adhesive layer to accurately indicate the desired placement of the precursor sections 58. In this embodiment, printing device 52 can comprise any device capable of making marks on the adhesive layer.

Alternatively, an adhesive layer can be applied to the backside or "inner surface" of precursor sections 58. The term "inner surface" is used to describe a surface of precursor section 58 that is closest to sleeve substrate 64 when precursor section 58 is mounted on sleeve substrate 64. In this embodiment, flexographic printing precursor 56 can have an adhesive layer applied to the inner surface thereof. Precursor sections 58 are then cut from the combined adhesive and flexographic printing precursor element 56. Alternatively, both the adhesive layer and the flexographic printing precursor 56 can be cut separately and then combined together after cutting. In either embodiment, registration marks 62 can be printed directly on sleeve substrate 64. "Adhesive layer" includes any adhesive for attaching precursor sections 58 to sleeve substrate 64. The adhesive could be in tape or sheet form, or coated, sprayed, or otherwise applied to either the outer surface of sleeve substrate 64 or the inner surface of precursor sections 58.

FIG. 4-B schematically shows another embodiment of the invention, where the mounting of the precursor sections 58 on sleeve substrate 64 with the aid of registration marks 62 could be done on a separate mounting jig such as mounting device 54. Mounting device 54 could be, but is not limited to, a simple laminator or more complicated post-mounters with video cameras and monitors. Controller 21 can be used to provide mounting device 54 with registration information 24 that comprises additional positioning information for attaching the precursor sections 58 on sleeve substrate 64. This positioning information can include the registration marks 62 and can also include a "materials list" that defines which specific precursor sections 58 are to be mounted on a particular sleeve substrate. Advantageously, since the plate has been accurately cut in the automated cutting step, the edges of the photopolymer plate sections can be lined up with the printed registration marks 62 ensuring accurate placement of the plate sections on the sleeve substrate.

In yet another embodiment of the invention, printing device 52 is not used. In this embodiment, mounting device 54 would be used to directly attach precursor sections 58 to a sleeve substrate 64. The Cyrel® Microflex Premounter is an example of such a device (the device is sold for DuPont by Alliance Services Group). This mounting device is used to mount precursor sections onto a sleeve substrate prior to imaging. The sleeve substrate is mounted in the device and is rotationally controlled along its axis. The device has a table system with moveable precursor guides that axially align the precursor sections in relation to required rotational position of the sleeve substrate. An adhesive layer is applied to the sleeve substrate. The sleeve substrate is rotated to a correct rotational position and the precursor guide is moved to a correct axial position. A precursor section is then aligned to the precursor guide. The precursor section is then adhered to the sleeve substrate in correct alignment by sliding it off the table into contact with the sleeve substrate. Such devices feature varying levels of automation and some even accept indexing information defining the intended position of the precursor on the sleeve substrate. In this embodiment, controller 21 can provide registration information 24 that includes positioning information comprising indexing information for mounting device 54. The indexing information is provided directly to mounting device 54 via any suitable electronic data communication means. Alternatively, controller 21 can provide positioning information in the form of a list of indexing information parameters that the operator would manually input into mounting device 54.

Yet another preferred embodiment of the invention incorporates at least one of the printing means of printing device 52 and mounting means of mounting device 54 into an imaging device (not shown). In this embodiment, controller 21 would provide registration information 24 directly to a digital imager to provide for the operation of the printing and/or mounting means as per the spirit and scope of the invention.

Figure 6:
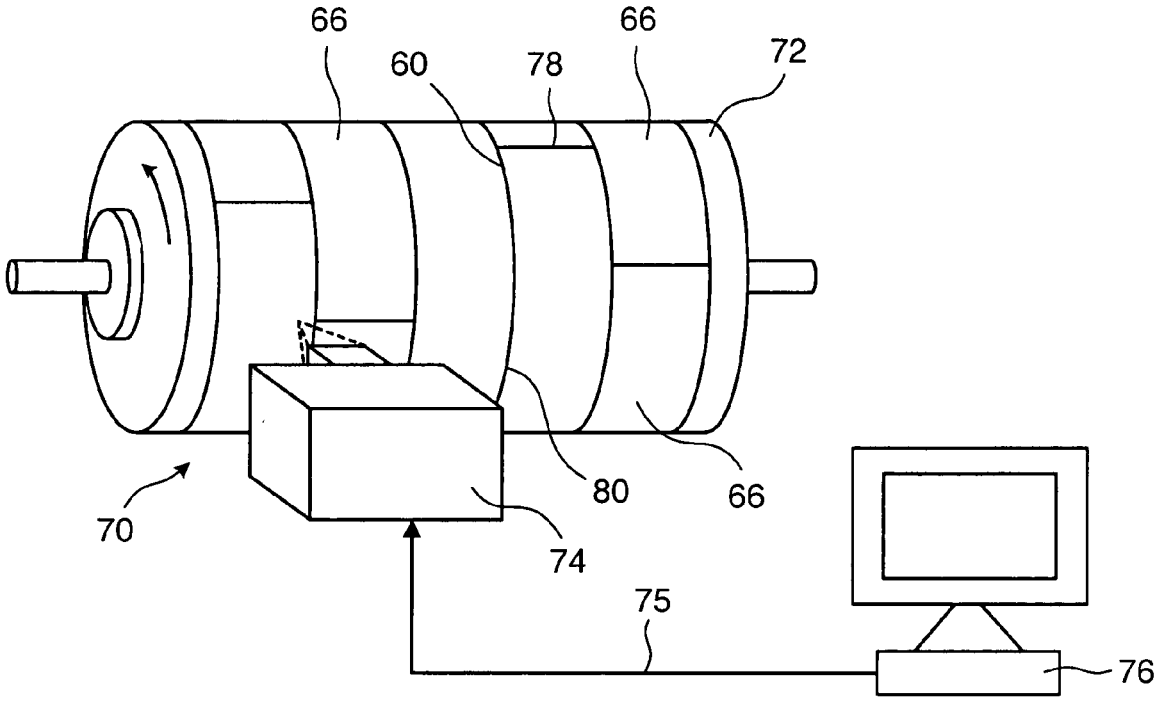
FIG. 6 shows an imaging engine in accordance with an embodiment of the invention.

A digital imaging device incorporates an imaging engine 70, shown in FIG. 6, comprising a rotatable imaging drum 72 and an imaging head 74. Imaging drum 72 has several un-imaged precursor elements 66 secured to its surface in lanes with staggered horizontal seams 78. Between the lanes are vertical seams 60. For the purpose of illustrating this invention, "vertical seam" will herein refer to any seam that is aligned substantially circumferentially with the imaging drum, and "horizontal seam" will herein refer to any seam that is aligned substantially with the rotational axis of the imaging drum. Precursor elements 66, which can be part or all of an un-imaged flexographic printing precursor, are mounted directly on the surface of imaging drum 72 to form a flexographic printing composite. Alternatively, precursor elements 66 can be mounted on an intermediate carrier that is in turn supported on an imaging drum to form a flexographic printing composite. An intermediate carrier can comprise any media support means including planar as well cylindrical formes such as a sleeve substrate. The term "support" will herein refer to an imaging drum, or to at least one intermediate carrier engaged onto an imaging drum. The flexographic printing composite is then imaged by imaging head 74.

Imaging head 74 is equipped with edge detection hardware as described in U.S. provisional patent application 60/473,127 entitled "Method and apparatus for detecting the edge of an imaging media" and incorporated herein by reference. The edge of the media is detected by directing a beam of light onto the precursor element surface in the vicinity of the seam and then scanning the beam over the seam. The reflection of the beam is monitored by one or more sensors and the seam discontinuity generates corresponding discontinuities in the sensor signals. By additionally monitoring the scan position of the beam and/or the imaging head the seam can be accurately located. An edge detection means may be employed, comprising various sensors that include but are not limited to, optical illuminators and sensors, and tactile sensors. Further, magnetic and/or electrical sensors can be employed if the precursor elements are mounted on an imaging drum or an intermediate carrier, which is magnetic and/or conductive in nature. Further, although a preferred embodiment would be to incorporate the edge detection means within imaging head 74, the edge detection means can be incorporated into any sub-system that will allow at least a part of the imaging drum to be sensed.

A controller 76 is configured to provide seam layout information to image head 74 via an interface connection 75. In this embodiment the securing of precursor elements 66 to the surface of imaging drum 72 need not be extremely precise since imaging head 74 uses its edge detection means to search for and accurately locate the actual position of vertical seams 60 on imaging drum 72. The seam layout information, transferred to the imaging engine 70 via interface connection 75, is used by the imaging head 74 to narrow the search area. Similarly the edge detection means of imaging head 74 can also be used to locate horizontal seams 78 to ensure correct registration of the image in the drum rotation direction.

Figure 7:
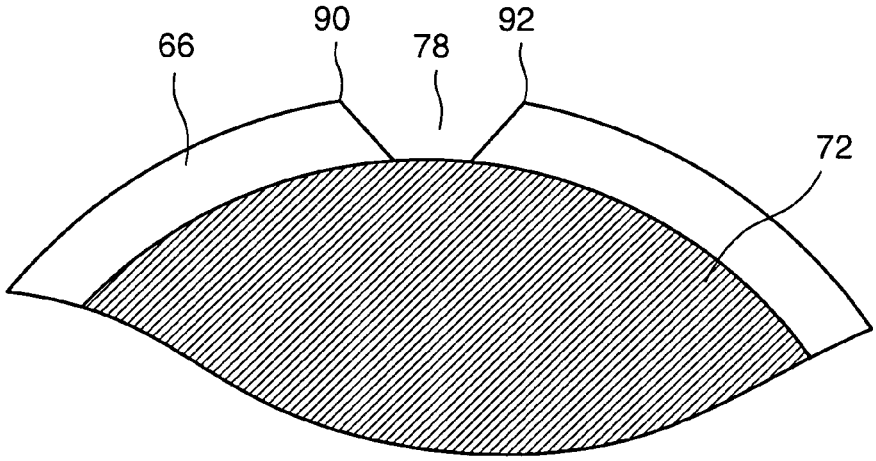
FIG. 7 is a section end view of a portion of an imaging drum with precursor element mounted thereon.

In FIG. 7, a portion of imaging drum 72 has a precursor element 66 attached thereto. A horizontal seam 78 between abutting ends of the precursor element defines two edges 90 and 92. The location of seam 78 can be determined by using the edge detection system to locate edges 90 and 92. The location of the seam is then taken as the mid point between edges 90 and 92. In this way when precursor element 66 is imaged the image will be circumferentially centered on the precursor element. Alternatively, the image can be offset by a known desired distance from either edge 90 or edge 92, or from any point between the two edges. In this case, it can be advantageous to detect both edges to ensure that the offset is applied to the correct edge.

In this application and the appended claims the term "seam" should be understood to apply to a gap between any two edges of precursor elements mounted on a support. The edges can be closely abutting or there can be a more substantial distance between the edges. While the depicted seams are shown running in either the drum circumferential direction, or in the "along the drum" (drum rotational axis) direction, this is not mandated and the seam can be at any angle is or can even be irregular.

Once the position of a particular precursor element 66 has been identified by accurately locating its associated horizontal and vertical seems, controller 76 sends image data for that particular element to the imaging head 74. Imaging head 74 then images the precursor element 66, whereafter the next seams are located, verified and the process is repeated. Alternatively the seams can all be located before any imaging commences, each seam location being stored in a memory for later use.

In some instances, particularly when a mounting device is used to mount the precursor elements, the lateral mounting accuracy can be adequate to dispense with a vertical seam location, in which case only the horizontal seams need be located. Further, if the rotational mounting accuracy between successively mounted precursor elements is adequate enough, only the horizontal seam nearest the point corresponding to the start of imaging need be located.

Advantageously, in this embodiment, inaccuracies in the cutting or placing of the precursor elements 66 on imaging drum 72 are compensated for by determining the exact locations of seams 60 and/or seams 78. Images are thus always placed in correct registration on the precursor elements 66. Additionally the edge detection can be performed in a second location 80 to determine whether a particular mounted precursor element is tilted, and if so, whether the tilt is too large. If the precursor element has been mounted with too large a tilt, the image may no longer be able to fit on the precursor element. In this case it is prudent to rather abort the imaging rather than produce an unusable precursor element.

The interface connection 75 between the imaging head 74 and the controller 76 can be any data transmission means capable of operably connecting the elements including, but not limited to, an electrical cable, an optical fiber or a free space optical connection. The connection 75 can also comprise transferring the data via storage means such as a removable computer disk or a USB memory key.

While the transfer of seam layout information to imaging head 74 conveniently narrows the area of search, such a transfer is not mandated by the invention. In absence of this information a wider edge search can be used to locate part or all of the seams, although this search may be significantly slower. In practice, since data representing the actual images to be plotted is commonly available and an interface 75 between imaging head 74 and controller 76 usually exists for other reasons, it is convenient to use seam layout information to speed up the seam location operation.

Advantageously, for exposure heads that have an autofocus system to keep the imaging beams in focus on the precursor surface during imaging, such autofocus systems can be used as edge detection means to locate the position of horizontal seams 78 and vertical seams 60 prior to imaging. This is possible because these autofocus systems typically comprise an illumination source and an optical sensor to detect a reflection of the light transmitted by the illumination source onto the media. An autofocus system suitable for uses in an imaging engine is described in commonly assigned U.S. Pat. No. 6,137,580 to Gelbart, incorporated herein by reference. However, during imaging, the discontinuity represented by a seam such as horizontal seam 78 will likely present to the autofocus system as an out-of-range error since there is inevitably a discontinuity in reflection in the seam area. Prior knowledge as to the location of seams like horizontal seams 78 allows the autofocus system to be configured to ignore sensor readings in the location of the seam thus preventing a focus malfunction.

It should be readily apparent that while the embodiment depicted in FIG. 7 is described in relation to precursor elements mounted in lanes, the seam location can be similarly performed on a staircase cut precursor element. Generally a staircase cut precursor element is to some extent self registering but mounting inaccuracies are still possible and detecting the seam locations is still required to align the subsequent image to the seam (especially in the circumferential orientation). Clearly, the methods of detecting the seams described herein are also equally applicable to any complex seam pattern. Further, the methods of detecting the seams described herein are also equally applicable precursor elements that are directly engraved e.g. by a high power $CO_2$ laser.

The advantage of the digital Plate-on-Sleeve process outlined above is primarily in the replacement of previously manual steps with automated processes that improve the accuracy of the operation while also reducing the time taken in tedious manual operations. The application of the methods of the present invention will speed up these processes and improve registration accuracy. Further, the ability to use edge detection means to detect the location of seams associated with the mounting of precursor sections, improves the accuracy and the time required in terms of registering an image on the precursor sections. The possibility of operator error is also reduced throughout the digital Plate-on-Sleeve process addressed by this invention.

As will be apparent to those skilled in the art in light of the foregoing disclosure, many alterations and modifications are possible in the practice of this invention without departing from the spirit or scope thereof.

What is claimed is:

1. A method for making an imaged flexographic printing sleeve, the method comprising the steps of:

a) providing seam layout information representing an arrangement of one or more precursor sections on a sleeve substrate based on at least one image to be imaged on the flexographic printing sleeve;

b) automatically cutting a flexographic printing precursor into the one or more precursor sections using a controllable cutting device responsive to the seam layout information;

c) creating a flexographic printing sleeve by attaching the one or more precursor sections to the sleeve substrate;

d) imaging the flexographic printing sleeve;

e) displaying a preview of an image to be imaged on the flexographic printing sleeve;

f) defining the arrangement based on the preview; and g) deriving at least a part of the seam layout information from the arrangement.

2. The method of claim 1 comprising the further step of defining the arrangement based on at least an image to be imaged on the flexographic printing sleeve.

3. The method of claim 1 comprising the further step of deriving at least a part of the seam layout information according to an algorithm.

4. The method of claim 3 comprising the further step of defining the arrangement based on at least an image to be imaged on the flexographic printing sleeve.

5. The method of claim 3 comprising the further steps of:

a) displaying a preview of an image to be imaged on the flexographic printing sleeve;

b) defining the arrangement based on the preview; and c) deriving at least a part of the seam layout information from the arrangement.

6. The method of claim 3, wherein the algorithm minimizes flexographic printing precursor wastage.

7. The method of claim 1, wherein the step of attaching the one or more precursor sections to the sleeve substrate occurs on one of:

a) a mounting device and b) a digital imaging device.

8. The method of claim 1 comprising the further step of determining registration information representing the arrangement.

9. The method of claim 8 comprising the further step of defining the arrangement from at least an image to be imaged on the flexographic printing sleeve.

10. The method of claim 8, wherein at least a part of the registration information is determined according to a first algorithm.

11. The method of claim 10 comprising the further step of deriving at least a part of the seam layout information according to a second algorithm.

12. The method of claim 10 comprising the further step of defining the arrangement based on at least an image to be imaged on the flexographic printing sleeve.

13. The method of claim 10 comprising the further steps of:

a) displaying a preview of an image to be imaged on the flexographic printing sleeve;

b) defining the arrangement based on the preview; and c) determining at least a part of the registration information from the arrangement.

14. The method of claim 13 comprising the further step of deriving from the arrangement at least a part of the seam layout information.

15. The method of claim 8 comprising the further step of printing registration marks on the sleeve substrate prior to the attaching the one or more precursor sections to the sleeve substrate, the printing being done in accordance with the registration information.

16. The method of claim 15 comprising the further step of applying an adhesive layer to an outer surface of the sleeve substrate prior to the printing.

17. The method of claim 15 comprising the further step of applying an adhesive layer to an inner surface of the one or more precursor sections prior to the attaching the one or more precursor sections to the sleeve substrate.

18. A method of making an imaged flexographic printing sleeve, the method comprising the steps of:

a) providing seam layout information representing an arrangement of one or more precursor sections on a sleeve substrate based on at least one image to be imaged on the flexographic printing sleeve;

b) automatically cutting a flexographic printing precursor into the one or more precursor sections using a controllable cutting device responsive to the seam layout information;

c) creating a flexographic printing sleeve by attaching the one or more precursor sections to the sleeve substrate; and d) imaging the flexographic printing sleeve;

e) displaying a preview of an image to be imaged on the flexographic printing sleeve;

f) defining the arrangement based on the preview; and g) determining registration information, at least part of the registration information being determined from the arrangement.

19. The method of claim 18 comprising the further step of deriving from the arrangement at least a part of the seam layout information.

20. A method of making an imaged flexographic printing sleeve, the method comprising the steps of:

a) providing seam layout information representing an arrangement of one or more precursor sections on a sleeve substrate;

b) automatically cutting a flexographic printing precursor into the one or more precursor section using a controllable cutting device responsive to the seam layout information; and c) creating a flexographic printing sleeve by attaching the one or more precursor sections to the sleeve substrate;

d) imaging the flexographic printing sleeve; and e) determining registration information representing the arrangement;

wherein the steps of attaching the one or more precursor sections to the sleeve substrate occurs on a mounting device an wherein the mounting device is responsive to the registration information.

21. The method of claim 20 wherein the registration information comprises positioning information for the attaching of the one or more precursor sections to the sleeve substrate.

22. The method of claim 21, wherein the positioning information comprises registration marks.

23. The method of claim 21, wherein the positioning information comprises indexing information.

24. A method for making imaged flexographic printing sleeve, the method comprising the steps of:

a) providing seam layout information representing an arrangement of one or more precursor sections on a sleeve substrate;

b) automatically cutting a flexographic printing precursor into the one or more precursor sections using a controllable cutting device responsive to the seam layout information;

c) creating a flexographic printing sleeve by attaching the one or more precursor sections to the sleeve substrate;

d) imaging the flexographic printing sleeve; and e) printing on at least a part of the one or more precursor sections at least one of reference indicia and reference characters.

25. The method of claim 24, wherein the further step of printing is done in accordance with the seam layout information.

26. The method of claim 24, wherein at least one of reference indicia and reference characters are printed on the at least a part of the one or more precursor sections prior to the step of automatically cutting the flexographic printing precursor.

* * * * *